US008474273B2

(12) United States Patent
Gibson

(10) Patent No.: US 8,474,273 B2
(45) Date of Patent: Jul. 2, 2013

(54) APPARATUS AND METHOD FOR PROVIDING A TEMPERATURE-CONTROLLED GAS

(75) Inventor: Daniel James Gibson, Pen Argyl, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 710 days.

(21) Appl. No.: 12/608,746

(22) Filed: Oct. 29, 2009

(65) Prior Publication Data

US 2011/0100026 A1 May 5, 2011

(51) Int. Cl.
*F17C 9/04* (2006.01)

(52) U.S. Cl.
USPC ..... 62/50.4

(58) Field of Classification Search
USPC ..... 62/50.4, 48.1, 49.1, 50.1, 50.2, 97, 62/122, 121, 171, 74
See application file for complete search history.

(56) References Cited

U.S. PATENT DOCUMENTS

| | | | | |
|---|---|---|---|---|
| 3,705,500 | A * | 12/1972 | Jehle | 62/223 |
| 4,011,734 | A | 3/1977 | Jones | |
| 4,654,094 | A | 3/1987 | Ritter | |
| 4,654,107 | A | 3/1987 | Ritter | |
| 4,749,337 | A | 6/1988 | Dickinson et al. | |
| 4,755,118 | A | 7/1988 | Ondush et al. | |
| 4,783,972 | A * | 11/1988 | Tyree et al. | 62/374 |
| 5,344,478 | A | 9/1994 | Zurecki et al. | |
| 5,394,704 | A * | 3/1995 | Johnson | 62/51.1 |
| 5,771,946 | A * | 6/1998 | Kooy et al. | 141/82 |
| 6,263,680 | B1 | 7/2001 | Newman et al. | |
| 6,363,730 | B1 | 4/2002 | Thomas et al. | |
| 6,389,828 | B1 | 5/2002 | Thomas et al. | |
| 6,497,106 | B2 | 12/2002 | Lang et al. | |
| 6,658,864 | B2 | 12/2003 | Thomas et al. | |
| 7,054,764 | B2 | 5/2006 | Williams et al. | |
| 2003/0029176 | A1 | 2/2003 | Thomas et al. | |
| 2006/0228465 | A1 | 10/2006 | Zurecki | |
| 2008/0048047 | A1 | 2/2008 | Zurecki et al. | |
| 2009/0019869 | A1 * | 1/2009 | Girard et al. | 62/168 |
| 2009/0111276 | A1 | 4/2009 | Dhindsa et al. | |
| 2009/0133411 | A1 * | 5/2009 | Cheng | 62/62 |

FOREIGN PATENT DOCUMENTS

| | | | |
|---|---|---|---|
| EP | 1 152 203 | A1 | 11/2001 |
| EP | 1 612 495 | A1 | 1/2006 |
| TW | 200924017 | A1 | 6/2009 |
| WO | 2008/027900 | | 3/2008 |
| WO | 2009/029659 | | 3/2009 |
| WO | 2009-032688 | | 3/2009 |
| WO | 2009/032689 | | 3/2009 |
| WO | 2009/032700 | | 3/2009 |
| WO | 2009/032709 | | 3/2009 |
| WO | 2009/032709 | A1 | 3/2009 |
| WO | 2009/100747 | | 8/2009 |

* cited by examiner

*Primary Examiner* — Melvin Jones
(74) *Attorney, Agent, or Firm* — Eric J. Schaal; Larry S. Zelson

(57) ABSTRACT

A coolant delivery system and method for maintaining a temperature within a predetermined range of a set-point temperature in a vessel into which a coolant gas is discharged or a temperature of a material onto which the coolant gas is discharged. The coolant gas results from the mixing of a supply gas with a cryogen. Temperature regulation is provided by regulating the flow rate of a cryogen using a proportional valve, while providing an essentially constant flow rate of a supply gas.

18 Claims, 4 Drawing Sheets

APPARATUS AND METHOD FOR PROVIDING A TEMPERATURE-CONTROLLED GAS

BACKGROUND

Embodiments of the present invention are directed to delivering a cold gas at a controlled temperature to a vessel using a cryogen to maintain the temperature of the cold gas.

Many methods exist for supplying a cold gas at a controlled temperature to a vessel. Examples include mechanical cooling of a gas (compression & evaporation of a refrigerant), allowing a liquid cryogen to vaporize prior to being supplied to the vessel, and using a variable flow-rate "throttling gas" to control the temperature at which a cryogen is supplied to the vessel.

There are, however, several problems associated with these methods. Mechanical cooling requires use of refrigerants, such as fluorocarbons, ammonia, sulfur dioxide, and methane, which are toxic and/or environmentally hazardous. In addition, mechanical cooling is very inefficient at very low temperatures (e.g., below zero degrees C.).

Methods in which the cooling gas consists primarily of a vaporized liquid cryogen are susceptible to delivering at least some cryogen in liquid phase. Any surface in the vessel that comes in contact with the liquid phase cryogen is, therefore, subjected to intense, concentrated cooling. This is undesirable in applications in which the product being cooled in the vessel may be damaged by contact with the liquid phase cryogen and/or where the product is not intended to be frozen.

PCT International Application No. PCT/US08/74506, filed Aug. 27, 2008, discloses a cryogenic cooling system in which a cryogenic fluid is supplied at a constant flow rate and the flow rate of a "throttling gas" is used to control the temperature of a resultant fluid using temperature feedback from the resultant fluid flow stream. This type of system, however, exhibits poor performance characteristics if the coolant gas (resultant fluid) is supplied at relatively high flow rates, e.g., 3700 standard cubic feet per hour (SCFH) or higher, which are desirable for many applications. In addition, the temperature feedback sensor for this type of system must be placed in the resultant fluid supply line, preferably just downstream from the point at which the cryogenic fluid and throttling gas supply lines intersect. This is an undesirable limitation in applications in which it is desirable to have temperature feedback from the material being cooled or the vessel into which the resultant fluid is being discharged. Also, in order to provide stable resultant fluid temperature characteristics, the cryogenic fluid must be supplied using a specialized hose that minimizes vaporization of the cryogenic fluid, such as the triaxial cryogenic fluid supply line.

Accordingly, there is a need for an improved system and method capable of delivering a temperature-controlled cooling gas at relatively high flow rates, at a wide range of temperatures (including well-below zero degrees C.) and in a cost-effective manner. This need is addressed by the embodiments of the invention described herein and by the claims that follow.

BRIEF SUMMARY

In one embodiment, the invention comprises a method comprising supplying a gas to a mixing zone, supplying a cryogen to the mixing zone, discharging a coolant gas from the mixing zone into a vessel, the coolant gas comprising the gas and the cryogen, measuring a first temperature using a sensor, and maintaining the first temperature within a first predetermined range of a set-point temperature by regulating a flow rate at which the cryogen is supplied to the mixing zone.

In another embodiment, the invention comprises an apparatus for cooling a vessel, the apparatus comprising a gas supply line that is in fluid communication with a source of a supply gas and is adapted to deliver the supply gas to a mixing zone, a cryogen supply line that is in fluid communication with a source of a cryogen and is adapted to supply the cryogen to the mixing zone, a coolant delivery assembly comprising a coolant delivery line that supplies a coolant gas from the mixing zone to a coolant delivery device, the coolant gas comprising the supply gas and the cryogen, the coolant delivery line being located downstream from the mixing zone and being in fluid communication with the mixing zone, the coolant delivery device comprising at least one opening located within the vessel, a sensor being adapted to measure a first temperature, and a controller adapted to receive signals from the sensor. The controller is programmed to maintain the first temperature within a first predetermined range of a set-point temperature by regulating a flow rate at which the cryogen gas is supplied to the mixing zone.

DETAILED DESCRIPTION

Figure 1:
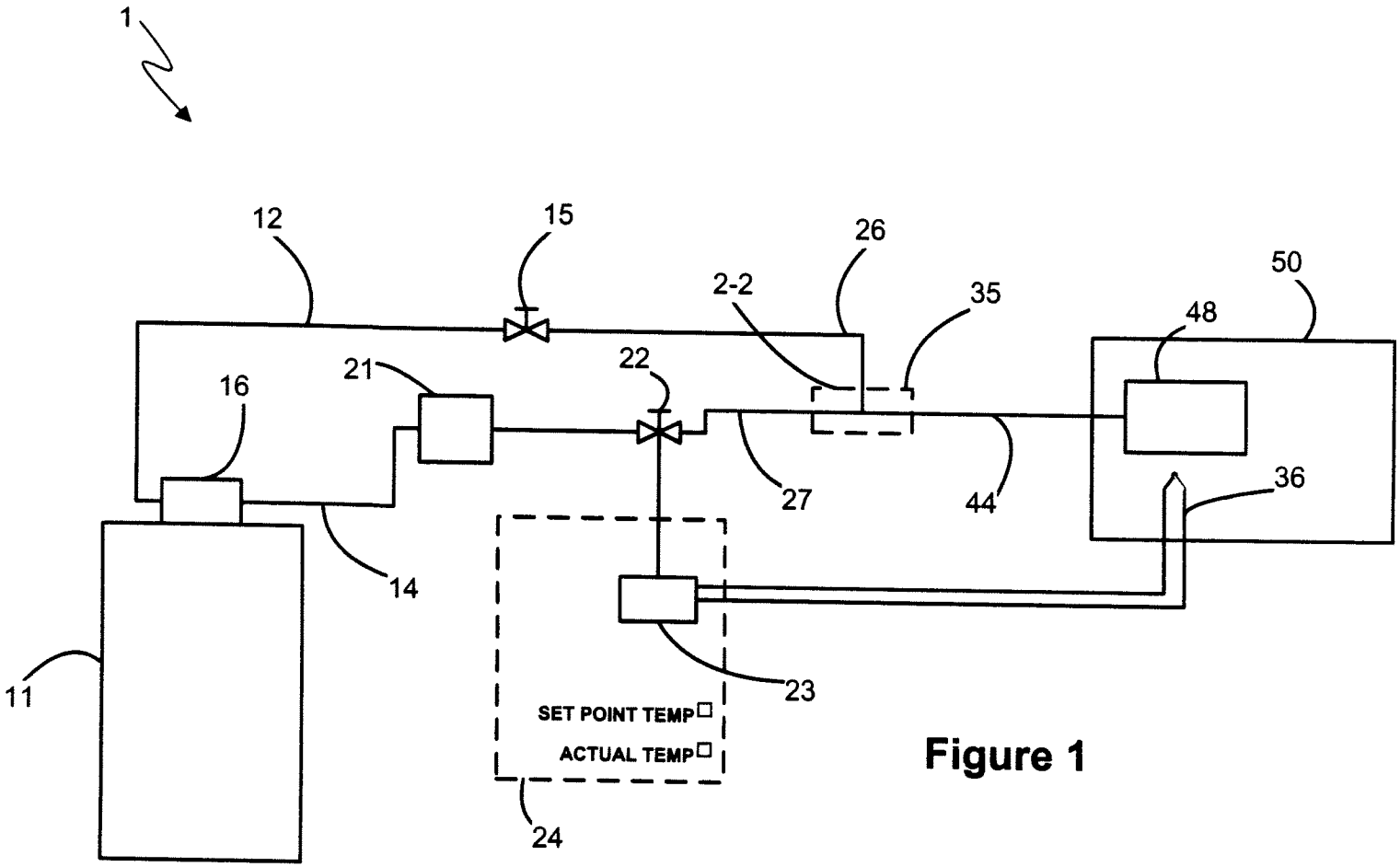
FIG. 1 is a block diagram showing an exemplary coolant delivery system.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention.

To aid in describing the invention, directional terms may be used in the specification and claims to describe portions of the present invention (e.g., upper, lower, left, right, etc.). These directional terms are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

As used herein, the term "cryogen" is intended to mean a liquid, gas, or mixed-phase fluid having a temperature less than −70 degrees C. Examples of cryogens include liquid nitrogen (LIN), liquid oxygen (LOX), liquid argon (LAR), liquid carbon dioxide and pressurized, mixed phase cryogens (e.g., a mixture of LIN and gaseous nitrogen).

Referring to FIG. 1, an exemplary coolant delivery system 1 is shown. The coolant delivery system 1 comprises cryogen supply line 14 and a gas supply line 12, which intersect at a mixing zone 35 and are then supplied to a vessel 50. A cryogen is supplied to the cryogen supply line 14 by a storage vessel, which is a tank 11 in this embodiment.

In this embodiment, gas for the gas supply line 12 (hereinafter "supply gas") is also supplied by the tank 11. The cryogen is separated into liquid and gas phases by a phase separator 16. A vaporizer (not shown) is preferably positioned around the interior perimeter of the tank 11 and feeds the gas phase to the phase separator 16. In this embodiment, the tank 11 provides a supply pressure of about 100 psig (7.0 kg/cm$^2$). The liquid phase is fed into the cryogen supply line 14, which is preferably controlled with a proportional valve 22. The gas phase is fed into the gas supply line 12, which preferably includes an on/off valve 15. In order to provide additional operational flexibility, a proportional valve (not shown) could optionally be provided instead of the on/off valve 15. Supply gas flows from the on/off valve 15 to a mixing zone 35 via a gas supply line 26.

In alternate embodiments, the gas supply line 12 could be supplied with pressurized gas from a source other that the tank 11. For example, a separate tank (not shown) could be provided or a pump (not shown) could be used. In order to avoid condensation and/or frost formation in the coolant delivery system 1, it is preferable that dry gas (e.g., less than 30% relative humidity) be supplied to the gas supply line 12.

In this embodiment, the cryogen is liquid nitrogen (LIN) and the supply gas is gaseous nitrogen (GAN). Alternatively, any suitable supply gas, for example helium, argon, oxygen, dry air, etc. may be used without departing from the scope of the present invention. The GAN is preferably supplied at a consistent temperature, and is preferably supplied at a higher pressure than the pressure at which the cryogen is supplied. A pressure differential of 20-30 psi (138-207 kPa) is preferable. All pressure values provided in this application should be understood as referring to relative or "gauge" pressure.

In order to avoid condensation or freezing of the supply gas, it is preferable that the supply gas have a boiling point that is no higher than the temperature operating range for the coolant delivery system 1. More preferably, the supply gas has a boiling point that is no higher than the boiling point of the cryogen. In some applications, it is also preferable for the supply gas and the cryogen to have the same chemical composition (as is the case in this embodiment) so that the chemical composition of the air inside the vessel 50 does not change as the flow rate of the cryogen is varied for reasons discussed herein.

LIN flows through the cryogen supply line 14, into a pressure regulator 21, through a proportional valve 22, through a distribution line 27, and into a mixing zone 35. The proportional valve 22 is preferably controlled by a programmable logic controller (PLC) 23. The PLC is preferably adapted to communicate with a user panel 24. As will be described in greater detail herein, the PLC 23 can adjust the proportional valve 22 for the purpose of increasing or decreasing the flow rate of the cryogen in the distribution line 27. In other embodiments, other types of proportional fluid control devices could be substituted for the proportional valve 22.

The proportional valve 22 is described herein as being used to regulate the temperature of the cooling gas that is supplied to the vessel 50. As used herein, the term "flow rate" should be understood to mean a volumetric flow rate. It should further be understood that the proportional valve 22 is adjusted by increasing or decreasing the size of the opening through which the cryogen flows, which causes a corresponding increase or decrease, respectively, in the flow rate of cryogen through the opening. Increasing the size of the opening also decreases the pressure drop across the proportional valve 22, and therefore, increases the pressure of the cryogen downstream of the proportional valve 22. Conversely, decreasing the size of the opening increases the pressure drop across the proportional valve 22, and therefore, decreases the downstream pressure of the cryogen. Therefore, due to the direct proportional relationship between flow rate and downstream pressure of the cryogen, adjusting the proportional valve 22 regulates both the flow rate and the pressure at which the cryogen is provided to the mixing zone 35. In addition, due to this direct proportional relationship, the supply characteristics of the supply gas and cryogen may be described herein in terms of either their respective flow rates or their respective pressures.

The cryogen that flows through the cryogen supply line 14 and through a pressure regulator 21, in this embodiment, maintains the cryogen at an operating pressure in the range of 60 to 120 psi (414 to 827 kPa) and, preferably, at about 80 psi (552 kPa).

Figure 2A:
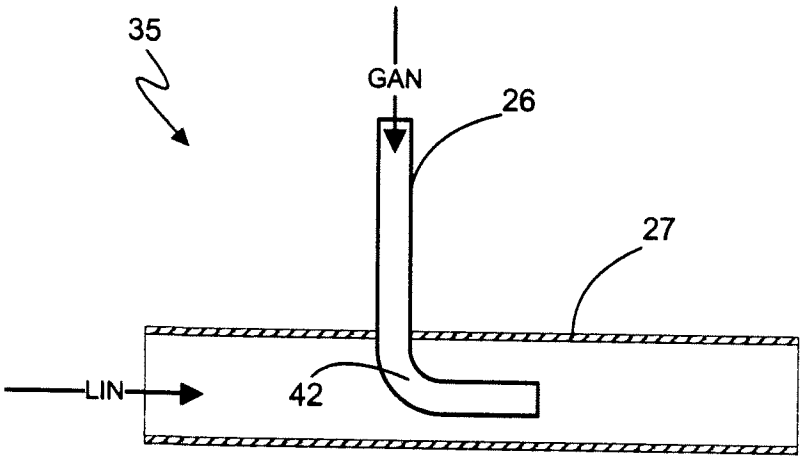
FIGS. 2A and 2B are examples of mixing tubes used with the coolant delivery system of FIG. 1 and represent an enlarged partial view of area 2-2 of FIG. 1.
Figure 2B:
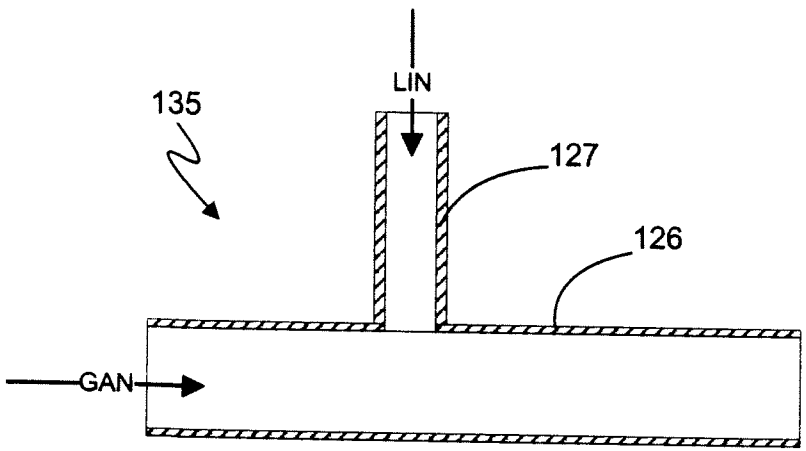

As noted above, the flow of supply gas intersects the flow of the cryogen at the mixing zone 35. The purpose of the mixing zone 35 is to enable the supply gas and cryogen to mix in a relatively uniform fashion. FIGS. 2A and 2B show two examples of mixing zone configurations. In the mixing zone 35, shown in FIG. 2A, the gas supply line 26 comprises a tube that intersects the distribution line 27, then includes an elbow 42 which orients the flow of supply gas exiting the gas supply line 26 roughly parallel to the flow of cryogen in the distribution line 27. The tube may be a copper tube, for example. Mixing zone 35 is intended for applications in which the GAN flow rate and the desired coolant gas temperature are relatively low (i.e., below 32 degrees F./zero degrees C.).

Mixing zone 135, shown in FIG. 2B, is intended for applications in which the GAN flow rate and desired coolant gas temperature are relatively high (i.e., above 32 degrees F./zero degrees C.). In mixing zone 135, the distribution line 127 intersects the gas supply line 126 at a right angle. In this embodiment, the distribution line 127 preferably has a smaller diameter than the gas supply line 126 in the mixing zone 135.

Referring again to FIG. 1, after intersecting at the mixing zone 35, the supply gas and the cryogen form a coolant gas, which flows through a delivery line 44 and is discharged through a coolant delivery device 48 into the vessel 50. The coolant delivery system 1 is preferably operated so that the coolant gas includes little or no liquid phase when it is discharged through the coolant delivery device 48. The temperature of the coolant gas will depend upon several factors, including, but not limited to, the temperatures and pressures (which, as explained above, are related to flow rates) at which the supply gas and cryogen are supplied to the mixing zone 35.

In this embodiment, a temperature probe 36 is positioned within the vessel 50 and is part of a thermocouple. The temperature probe 36 is configured to transmit continuous real time temperature measurements to the PLC 23. It should be understood that other temperature monitoring methods may be used in other embodiments without departing from the scope of the present invention. For example, optional temperature sensors (not shown) such as diodes, resistance temperature detectors, infrared sensors, and capacitance sensor thermometers, for example, may be used to monitor the surface temperature of the product, exhaust temperature, or contiguous atmosphere temperature, for example. In such an instance, the optional temperature sensors could transmit a stream of data to the PLC 23, as described in this embodiment.

Operation of the cryogenic coolant delivery system 1 begins by determining a target or set point temperature for the vessel 50. The value of the set point temperature, as well as how and where it is measured, will depend upon the process being performed in the vessel. For example, the set point temperature could be a desired air temperature within the vessel 50, a desired air temperature in an exhaust stack (not shown) of the vessel 50, or a desired surface temperature of a product as it enters or exits the vessel 50.

In this embodiment, the desired set-point temperature is entered into the user panel 24 by an operator and the set-point temperature is communicated to the PLC 23. In this embodiment, the set-point temperature can range from between about −240 degrees F. to about 85 degrees F. (−151 degrees C. to 29 degrees C.). In alternate embodiments, the set-point temperature could be fixed or non-user adjustable. In such embodiments, the set-point temperature could simply be part of the programming of the PLC 23.

During operation of the cryogenic coolant delivery system 1, if the temperature in the vessel 50, as measured by the thermocouple, deviates from the set-point, the PLC 23 is programmed to adjust the proportional valve 22 in order to bring the temperature in the vessel 50 back to the set-point temperature by adjusting the flow rate of the cryogen. Given that the composition, and therefore temperature, of the coolant gas is dependent, at least in part, on the pressure differential between the supply gas and the cryogen at the mixing zone 35, it is preferable that the flow rate (and pressure) at which the supply gas is supplied to the mixing zone 35 be as constant as possible.

In other embodiments, multiple temperature probes 36 could be used. In this case, deviation from the set-point could be determined a number of different ways. For example, the PLC 23 could be programmed to adjust the cryogen flow rate if any of the temperature probes 36 deviate sufficiently from the set-point, or the PLC 23 could be programmed to adjust the cryogen flow rate based on the average of the temperature probes 36.

Figure 3:
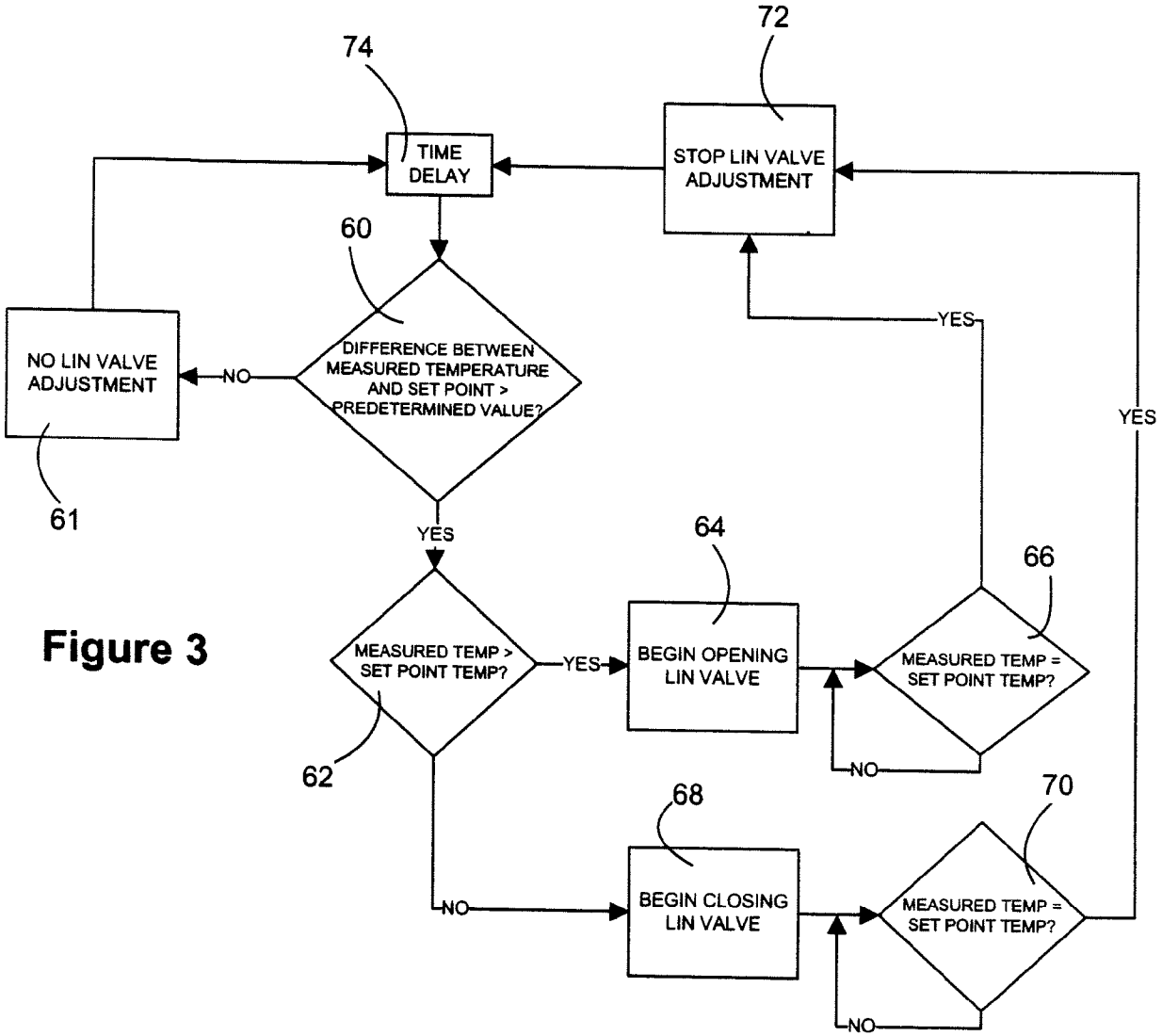
FIG. 3 is a flow chart showing an example of a method of controlling the coolant delivery temperature for the coolant delivery system of FIG. 1.

A flow chart showing an example of a method used by the PLC 23 to control coolant gas temperature is shown in FIG. 3. When the PLC 23 receives a temperature reading from the thermocouple, it determines the difference between the measured temperature and the set-point temperature and compares the difference to the predetermined range (see step 60). If the difference is not greater than the predetermined range, no adjustment of the proportional valve 22 is made by the PLC 23 (see step 61).

If the difference is greater than the predetermined range, the PLC 23 determines if the measured temperature is greater than the set-point temperature (see step 62). If so, the PLC 23 begins adjusting the proportional valve 22 to increase the flow rate of the cryogen (see step 64) until the measured temperature of the coolant gas drops to the set-point temperature (see step 66). If not, the PLC 23 adjusts the proportional valve 22 to decrease the flow rate of the cryogen (see step 68) until the measured temperature of the coolant gas rises to the set-point temperature (see step 70). When the measured temperature is equal to the set-point temperature, adjustment of the proportional valve 22 is stopped (see step 72).

A time delay (step 74) is preferably provided between each temperature measurement. The time delay steps and the predetermined range are intended to prevent constant adjustment of the proportional valve 22. The magnitude of the time delay and predetermined range will depend, in part, upon the acceptable temperature variation in the vessel 50.

If it is desirable to maintain a set-point temperature within an acceptable temperature range (a first predetermined range), it is preferable that the predetermined range of step 60 (a second predetermined range) be no greater than the acceptable temperature range and, more preferably, less than the acceptable temperature range. For example, if an application requires that the temperature measured by the thermocouple be within 5 degrees F. (2.7 degrees C.) of the set-point temperature, a predetermined range of two degrees F. (1.1 degrees C.) could be used.

Based on testing of a prototype of cryogenic coolant delivery system 1, the system is able to maintain temperature in a vessel within 1 degree F. (0.6 degrees C.) above or below a set temperature when operating at set temperatures above 32 degrees F. (zero degrees C.). The system 1 was able to maintain temperature in a vessel within 5 degrees F. (2.8 degrees C.) above or below a set temperature when operating at a set temperature of −150 degrees F. (−101 degrees C.).

In addition, the coolant delivery system 1 is capable of delivering coolant gas to a vessel at a flow rate of 5000 standard cubic feet per hour, while maintaining the above-referenced temperature control characteristics. This high flow rate capability enables the coolant delivery system 1 to be used in applications requiring a gaseous coolant at higher flow rates. In addition, the high flow rate capability provides for reduced vessel startup times and reduced temperature fluctuations under changing vessel conditions (e.g., when a material is first introduced into the vessel 50 or in applications in which the feed rate of the material varies substantially).

Figure 4:
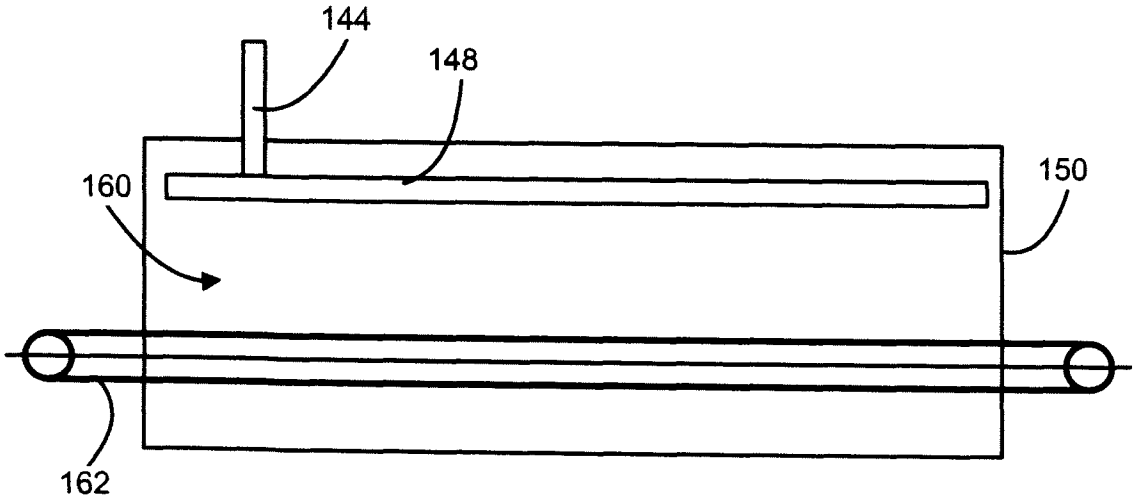
FIG. 4 is a sectional side view of one example of a vessel used with the coolant delivery system of FIG. 1.
Figure 5:
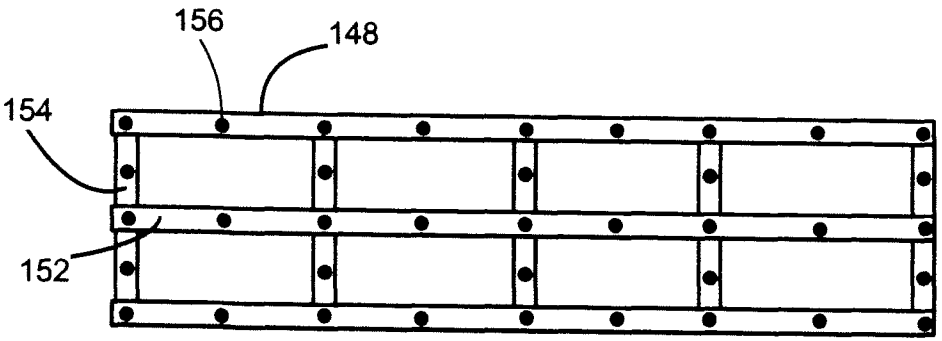
FIG. 5 is a bottom view of the coolant delivery device shown in FIG. 4.

FIGS. 4 and 5 show one example of a coolant delivery device 148 and a vessel 150 with which the coolant delivery system 1 could be used. The vessel 150 comprises a chamber 160 through which products are moved on a conveyor 162. The coolant delivery device 148 is located at the top of the chamber 160. The coolant delivery device 148 consists of a series of longitudinal pipes 152 and cross pipes 154. Gas from the delivery line 144 exits the delivery device through a plurality of holes 156 drilled in the pipes. The configuration of the holes 156 and pipes 152, 154 is intended to provide a relatively uniform flow of cooling gas over products moving through the chamber 160.

The cryogenic coolant delivery system 1 could be used to cool a wide variety of vessels. For example, the system could be used with a room or chamber in which a cool, temperature-controlled inert gas environment is desired. If GAN and LIN are used as the supply gas and cryogen, respectively, the system of the present invention would have the advantage of providing the desired temperature control without the potential for introducing contaminants into the inert environment. The following are examples of applications with which the coolant delivery system 1 can be used. In all three examples, GAN was used as the supply gas and LIN was used as the cryogen.

Example 1

In this example, the coolant delivery system 1 was used with a vessel 50 for the purpose of cooling a component of a food product from a temperature of 107 degrees F. (42 degrees C.) to a temperature of 50 degrees F. (10 degrees C.). The vessel 50 consisted of a cooling tunnel having a length of 7 feet (2.1 meters) and the temperature probe 36 was positioned within the cooling tunnel. The component was provided as a continuous 300 mm wide, 3-4 mm thick extrusion and was conveyed through the cooling tunnel at a rate of 0.25 feet per second (0.075 meters per second), which provided for a residence time of 28 seconds. The coolant delivery device 48 comprised a manifold that was positioned less than an inch above the top of the component.

Several tests were performed at different coolant gas temperatures to arrive at a coolant gas temperature that provided the desired temperature of 50 degrees F. (10 degrees C.) and additional characteristics for the component, i.e., that it remain flexible and smooth after cooling. Based on these tests, it was determined that a set-temperature of −145 degrees F. (−98 degrees C.) produced the desired results. Under these operating conditions, the LIN flow rate for the coolant delivery system 1 was about 3500 SCFH and the GAN flow rate (using a ¼ inch diameter supply line) was about 3500 SCFH, providing a total coolant gas flow rate of 7000 SCFH.

Example 2

In this example, the coolant delivery system 1 was used with a vessel 50 to cool a leafy vegetable food product to a temperature below 40 degrees F. (4 degrees C.) and preferably between 32 and 40 degrees F. (zero to 4 degrees C.). The vessel 50 consisted of a screw conveyor capable of operating at speeds of up to 35 revolutions per minute. The temperature probe 36 was positioned at the screw conveyor exit.

It was determined that maintaining a set-temperature of about −20 degrees F. (−29 degrees C.) provided acceptable results. Under these operating conditions, the LIN flow rate for the coolant delivery system 1 was about 5 pounds per minute (about 3450 SCFH) and the GAN flow rate (using a ⅛ inch diameter supply line) was about 1000 SCFH, providing a total coolant gas flow rate of 4450 SCFH.

Example 3

In this example, the coolant delivery system 1 was used to maintain a set-point temperature in a vessel 50 in which a step in the manufacturing process for a pharmaceutical compound was performed. In this example, the vessel 50 was used as a dryer or dryer component. The process step being performed in the vessel required a dry, inert atmosphere and maintenance of a set-point temperature of 50 degrees F. (10 degrees C.).

The cryogenic coolant delivery system 1 could also be configured for "dual mode" operation. In the first mode, the system 1 could be operated to deliver a temperature-controlled gas, as discussed above, with little or no liquid phase at the coolant delivery device 48. In the second mode, the system 1 could be operated with little or no flow from the gas supply line 26 and nearly 100 percent LIN in the delivery line 44. In the second mode, the system 1 could operate much like a conventional cryogenic spray device and could be used, for example, to crust-freeze food products. If dual mode operation is desired, it is preferable that the coolant delivery device 48 provide a desired spray pattern for any liquid phase cryogen.

As such, an invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A method comprising:

supplying a gas to a mixing zone;

supplying a cryogen to the mixing zone;

discharging a coolant gas from the mixing zone into a vessel, the coolant gas comprising the gas and the cryogen;

measuring a first temperature using a sensor; and maintaining the first temperature within a first predetermined range of above and below a set-point temperature by adjusting a proportional valve, which regulates a flow rate at which the cryogen is supplied to the mixing zone.

2. The method of claim 1, wherein the maintaining step further comprises maintaining the first temperature within the first predetermined range without adjusting a flow rate at which the gas is supplied to the mixing zone.

3. The method of claim 1, wherein the maintaining step comprises increasing the flow rate at which the cryogen is supplied to the mixing zone if the first temperature rises above the set-point temperature and outside of a second predetermined range and decreasing the flow rate at which the cryogen is supplied to the mixing zone if the first temperature drops below the set-point temperature and outside of the second predetermined range.

4. The method of claim 1, wherein the maintaining step further comprises maintaining the first temperature within the predetermined range of no more than 5 degrees F. (2.7 degrees C.) above or below the set-point temperature.

5. The method of claim 1, wherein the supplying a gas step comprises supplying the gas to the mixing zone at a first pressure that is greater than a second pressure at which the cryogen is supplied to the mixing zone.

6. The method of claim 1, wherein the supplying a gas step comprises supplying the gas to the mixing zone at a first pressure that is at least 20 psig (1.4 kg/cm2) greater than a second pressure at which the cryogenic fluid is supplied to the mixing zone.

7. The method of claim 1, wherein the supplying a gas step further comprises supplying a gas having the same chemical composition as the cryogen to the mixing zone.

8. The method of claim 1, wherein the measuring a first temperature step comprises measuring a first temperature using a sensor positioned within the vessel.

9. The method of claim 1, wherein the discharging step further comprises discharging the coolant gas from the mixing zone into a vessel at a rate of at least 1000 SCFH.

10. An apparatus for cooling a vessel, the apparatus comprising:

a gas supply line that is in fluid communication with a source of a supply gas and is adapted to deliver the supply gas to a mixing zone;

a cryogen supply line that is in fluid communication with a source of a cryogen and is adapted to supply the cryogen to the mixing zone, the cryogen supply line including a proportional valve;

a coolant delivery assembly comprising a coolant delivery line that supplies a coolant gas from the mixing zone to a coolant delivery device, the coolant gas comprising the supply gas and the cryogen, the coolant delivery line being located downstream from the mixing zone and being in fluid communication with the mixing zone, the coolant delivery device comprising at least one opening located within the vessel;

a sensor adapted to measure a first temperature; and a controller adapted to receive signals from the sensor;

wherein the controller is programmed to maintain the first temperature within a first predetermined range above and below a set-point temperature by adjusting the proportional valve, which regulates a flow rate at which the cryogen gas is supplied to the mixing zone.

11. The apparatus of claim 10, wherein the controller is programmed to maintain the first temperature within the first predetermined range without adjusting a flow rate at which the supply gas is supplied to the mixing zone.

12. The apparatus of claim 10, wherein the first predetermined range is no greater than 5 degrees F. (2.7 degrees C.) above and below the set-point temperature.

13. The apparatus of claim 10, wherein the gas supply line and the supply gas source are adapted to deliver the supply gas to the mixing zone at a first pressure that is greater than a second pressure at which the cryogen supply line supplies the cryogen to the mixing zone.

14. The apparatus of claim 13, wherein the first pressure is at least 20 psig (1.4 kg/cm2) greater than the second pressure.

15. The apparatus of claim 10, wherein the supply gas and the cryogen have the same chemical composition.

16. The apparatus of claim 10, wherein the sensor is positioned within the vessel.

17. The apparatus of claim 10, wherein the gas supply line, the cryogen supply line, the mixing zone and the coolant delivery assembly are operationally configured to supply coolant gas to the vessel at flow rates greater than 4000 SCFM.

18. The apparatus of claim 10, wherein the gas supply line, the cryogen supply line, the mixing zone and the coolant delivery assembly are operationally configured to supply coolant gas to the vessel at temperatures ranging from −210 to 85 degrees F. (−271 to 16 degrees C.).

* * * * *